US006145251A

United States Patent [19]

Ricci

[11] Patent Number: 6,145,251

[45] Date of Patent: Nov. 14, 2000

[54] ADJUSTABLE SHUTTER ASSEMBLY AND SLAT CONTROL MECHANISM USING A CONTROL GEAR AND GEAR ENGAGING POSITIONER

[76] Inventor: Fernando Ricci, 6380 Cabrini, Montréal, Québec, Canada, H1t 3S4

[21] Appl. No.: 09/398,050

[22] Filed: Sep. 17, 1999

[51] Int. Cl.[7] ..... E06B 7/096; E06B 7/086

[52] U.S. Cl. ..... 49/82.1; 49/74.1; 49/87.1

[58] Field of Search ..... 49/82.1, 74.1, 49/87.1, 403; 52/656.2

[56] References Cited

U.S. PATENT DOCUMENTS

| | | | |
|---|---|---|---|
| 234,317 | 11/1880 | Monk | 49/82.1 |
| 361,019 | 4/1887 | Morstatt | 49/82.1 |
| 421,047 | 2/1890 | Hantsche | 49/82.1 |
| 422,068 | 2/1890 | Cabus | 49/82.1 |
| 595,854 | 12/1897 | Lansing | 49/82.1 |
| 657,367 | 9/1900 | Starck | 49/87.1 |
| 1,582,129 | 4/1926 | Cornide | 49/82.1 |
| 1,701,695 | 2/1929 | Paine | 49/74.1 |
| 2,324,454 | 7/1943 | Huff | 49/74.1 X |
| 2,610,371 | 9/1952 | Hite | 49/82.1 |
| 2,995,787 | 8/1961 | Sarria | 49/87.1 |
| 3,680,470 | 8/1972 | Neece | 49/82.1 X |
| 4,435,920 | 3/1984 | Osaka et al. | 49/82.1 |
| 4,850,138 | 7/1989 | Watanabe et al. | 49/82.1 |
| 4,967,511 | 11/1990 | Werginz et al. | 49/74.1 X |
| 5,191,735 | 3/1993 | Ross | 49/74.1 |
| 5,379,551 | 1/1995 | Swapp | 49/82.1 |
| 5,467,556 | 11/1995 | Lin | 49/82.1 |
| 5,469,658 | 11/1995 | Dgianni et al. | 49/74.1 X |
| 5,490,353 | 2/1996 | McLaughlin | 49/64 |
| 5,634,306 | 6/1997 | Rigelman | 52/309.16 |
| 5,778,598 | 7/1998 | Ohanesian | 49/74.1 |
| 5,921,028 | 7/1999 | Marocco | 49/403 |
| 5,930,952 | 8/1999 | Ricci | 49/74.1 |

FOREIGN PATENT DOCUMENTS

| | | | |
|---|---|---|---|
| 128632 | 8/1948 | Australia | 49/87.1 |

*Primary Examiner*—Blair M. Johnson
*Assistant Examiner*—Gregory J. Strimbu
*Attorney, Agent, or Firm*—Swabey Ogilvy Renault; Guy J. Houle

[57] ABSTRACT

A shutter assembly which is comprised of a support frame formed by opposed parallel hollow side frame members and a bottom and top block member interconnected between the ends of the side frame members. A plurality of equidistantly spaced slats are pivotally inter-connected to one another and disposed between the side frame members in a parallel relationship. The side frame members each have a removably securable inner side wall which is provided with equidistantly spaced holes to receive opposed pivot pins of each of the slats. A slat positioning mechanism is disposed in one of the side frame members and has a pair of vertically disposed slat interconnecting bars. Pivot pin connectors are secured to each of the pivot pins and each has a pair of connecting arms pivotally connected to respective one of the slat interconnecting bars. A control gear, of circular disc shape, has gear teeth on at least an outer peripheral portion thereof. A controllable gear engaging mechanism is provided for rotating the gear to a desired position to displace the slat interconnecting bars to tilt the slats in unison to a desired angle and to retain them at that desired angle. The gear is also pivotally connected to a respective one of the pair of slat interconnecting bars.

20 Claims, 8 Drawing Sheets

ADJUSTABLE SHUTTER ASSEMBLY AND SLAT CONTROL MECHANISM USING A CONTROL GEAR AND GEAR ENGAGING POSITIONER

FIELD OF THE INVENTION

The present invention relates to a shutter assembly which can be custom fitted to varying size openings by its adjustability features and incorporating a slat positioning mechanism capable of positioning and maintaining the slats at a desired angle and locking the slats when in a closed position.

BACKGROUND OF THE INVENTION

There are various shutter assembly designs known in the prior art and the majority of these, such as exemplified by U.S. Pat. Nos. 3,991,518, 2,545,874 and 5,469,658, all utilize gears of, various forms, which are secured to a pivot rod and to at least one end of the slats. The gears are interconnected together and displaceable by turning a gear or interconnecting them by a rack whereby to adjust the position of the slats. A disadvantage of most of these mechanisms is that they are time-consuming to install, require precision in the assembly of various component parts of the mechanisms and in most cases the slat pivot positions are fixed and therefore it is difficult and time-consuming to adapt louvers to openings which vary in size. To do so, the top and bottom block members of the frame need to be modified to compensate for the increase length of the shutter and accordingly the shutter is not balanced and esthetically pleasing. In order to remedy this disadvantage U.S. Pat. No. 5,469,658 suggests the attachment of the gears to the pivot pins of the slats by the use of wedges which are inserted only after the assembly of the slats within the frame and with the gears of each slat disposed in engagement with the rack. This is a very time-consuming task and not a very practical one to solve the above-noted problem of the prior art as the assembly is still very time-consuming, and not practical for assembly particularly by non-skilled labour.

There is also a need to provide a shutter assembly which can be assembled by parts which interconnect together without using glue while still providing a rigid shutter frame which will not deform or become undone. There is also a need to provide a louver adjusting mechanism which is reliable, which is capable of maintaining the slats at a desired angle and which is also capable of locking the slats in a closed position. There is also a need to provide a shutter assembly which is esthetically pleasing. There is a still further need to provide a shutter assembly having a louver mounting system which is flexible and which can provide easy conversion for the mounting of slats at different spacing therebetween.

SUMMARY OF THE INVENTION

It is a feature of the present invention to provide a shutter assembly which overcomes the above-mentioned disadvantages of the prior art and meet the required needs as above-mentioned.

According to the above feature, from a broad aspect, the present invention provides a shutter assembly which comprises a support frame formed by opposed parallel hollow side frame members, and a bottom and a top block member interconnected between the side frame members adjacent opposed ends thereof. A plurality of equidistantly spaced slats are pivotally secured between the side frame members in pivotal parallel relationship and pivotally interconnected to one another in one of the hollow side frame members. The side frame members each have a removably securable inner side wall provided with equidistantly spaced holes to receive a pivot members of each of the slats. A slat positioning mechanism is disposed in the side frame members in which the slats are pivotally interconnected. The positioning mechanism has a pair of vertically disposed slat interconnecting bars. A pivot pin connector is secured to each of the pivot members which are to be interconnected and has a pair of connecting arms pivotally connected to a respective one of the pair of slat interconnecting bars. A circular disc shape control gear, is provided with gear teeth on at least an outer peripheral portion thereof. The gear has a pair of pivotal connections each secured to a respective one of the pair of slat interconnecting bars and disposed on a diametrical axis of the gear. Controllable gear engaging means is also provided for rotating the control gear to a desired position to impart translation displacement of the slat interconnecting bars to tilt the slats in unison to a desired angle and to hold them at that desired position.

BRIEF DESCRIPTION OF THE DRAWINGS

A preferred embodiment of the present invention will now be described with reference to the accompanying drawings in which.

DESCRIPTION OF PREFERRED EMBODIMENTS

Figure 1:
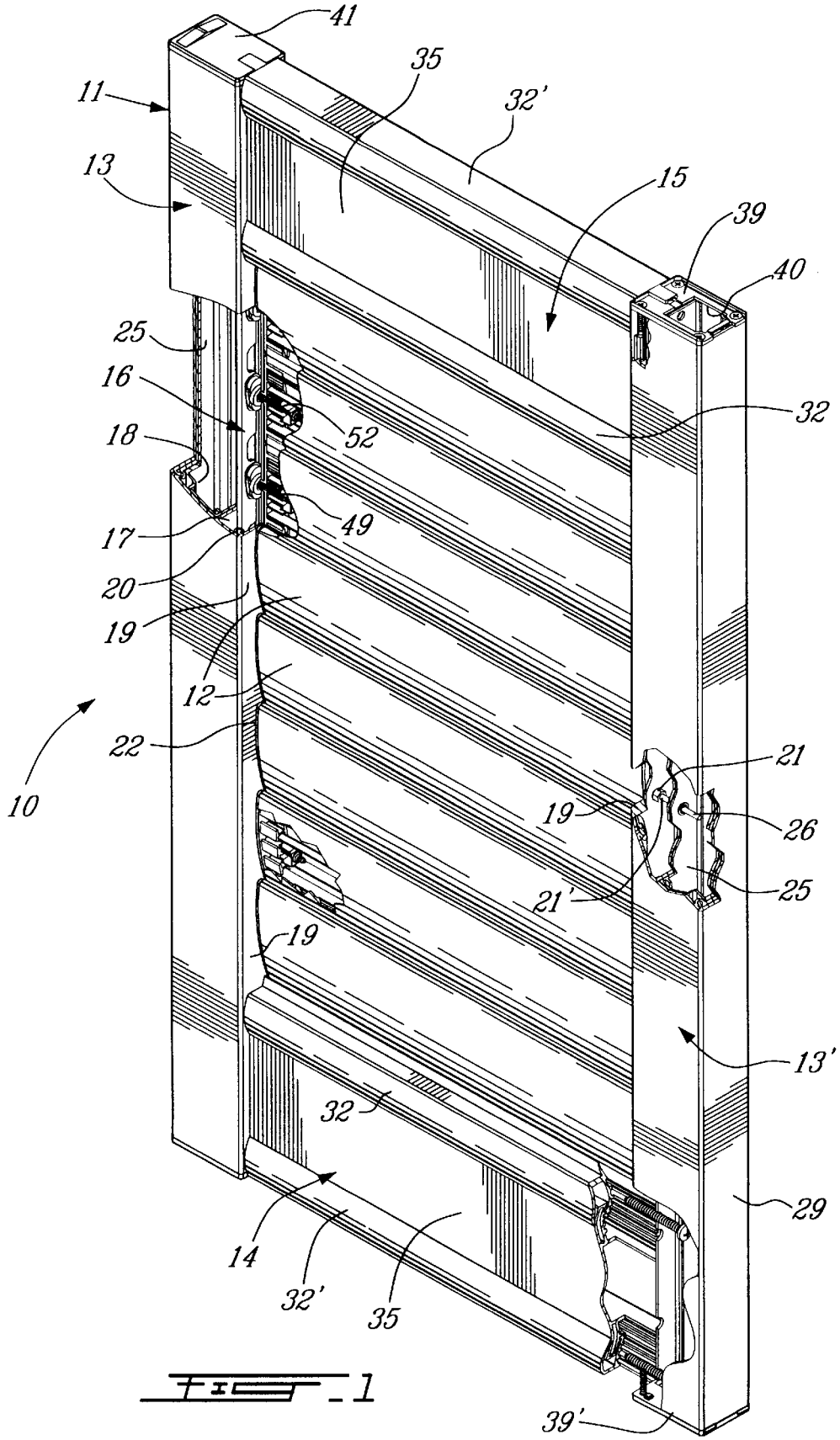
FIG. 1 is a perspective view, partly fragmented, showing part of the construction of the shutter assembly of the present invention.

Referring now to the drawings and more particularly to FIG. 1 there is shown generally at 10 a shutter assembly constructed in accordance with the present invention. The entire invention is not shown herein but this Figure illustrates primarily the construction of the support frame 11 and how the slats 12 are interconnected thereto. As hereinshown the support frame 11 is comprised of opposed parallel hollow side frame members 13 and 13', a bottom block member 14 and a top block member 15 which are interconnected between the side frame members 13 and 13' adjacent their opposed ends. The plurality of slats 12 are equidistantly spaced between one another and pivotally interconnected by a slat positioning mechanism 16 here only partly illustrated and disposed within an inner chamber 17 of one of the side frame members, herein side frame member 13.

Figure 2:
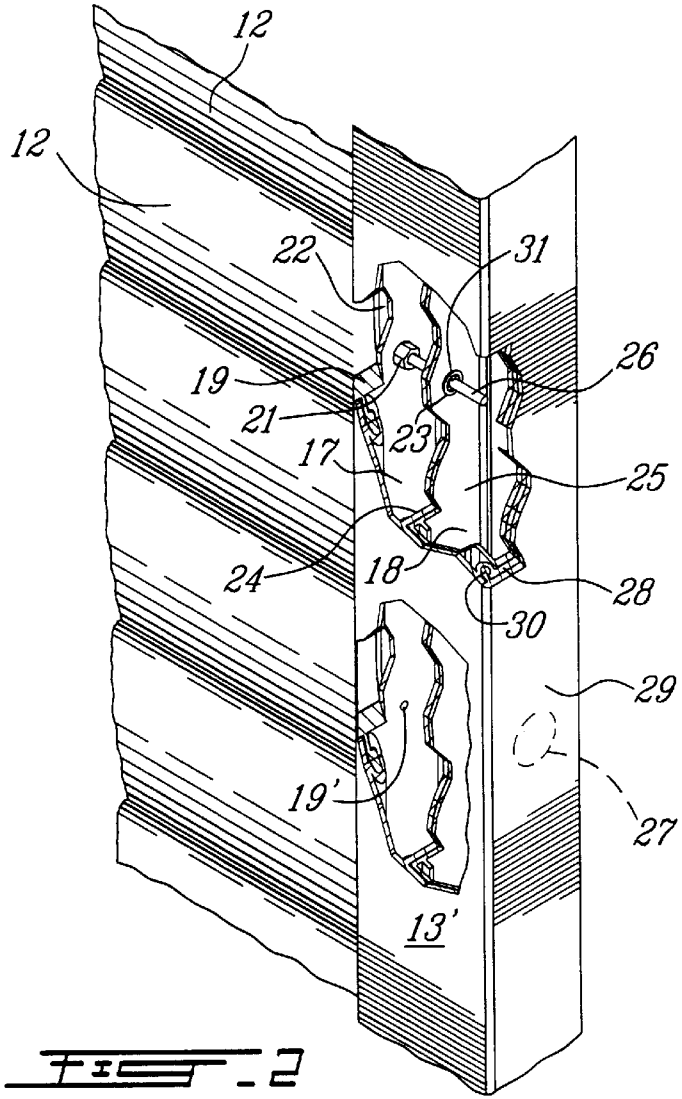
FIG. 2 is a fragmented perspective view through a side frame member showing its cross-sectional construction and the pivotal attachment of a slat pivot pin thereto.

With further reference to FIG. 2 it can be seen that the hollow side frame members 13 and 13' are each formed of plastic extruded parts and define two chambers, herein an outer larger chamber 18 and a smaller inner chamber 17. A removably securable inner side wall 19 is slidably connected through connections 20 and provides an inner wall of the inner chamber 17. The inner side wall 19 is also provided with equidistantly spaced holes 19' (see FIG. 2) whereby to receive therein the pivot pins 21 formed integral with the end caps 22 of the slats 12. If the spacing of these holes 19' needs to be modified due to the size of the support frame 11 and a different spacing of the slats, then all that is necessary to be modified is the provision of an inner side wall 19 with modified pivot hole spacings. Once the inner side wall 19 is positioned it is then possible to drill aligned matching holes 23 in an inner side wall 24 of the outer chamber 18. As shown in FIG's 1 and 2, the outer chamber 18 is reinforced by inserting therein a reinforcing hollow metal tube 25 which is positioned in close fit whereby to strengthen the side frame members to prevent warping. These reinforcing hollow metal tubes are sections of hollow extruded aluminum tubing.

In order to provide access to the end portion of a support pin 26 which is held captive within the ends of the pivot pins 21, holes 27 are formed in the outer side wall 28 of the outer chamber 18. A facing strip 29 is slideably engaged over the outer side wall 28 in a slide connecting 30 similarly to the connection of the inner side wall 19. These access holes 27 permit lock washers 31 to be secured to the support pins 26 and the removal of same, if it becomes necessary to change or modify one of the slats. The support pins 26 extend longitudinally in the slats to prevent flexion of the side frames when they are very long.

Figure 3:
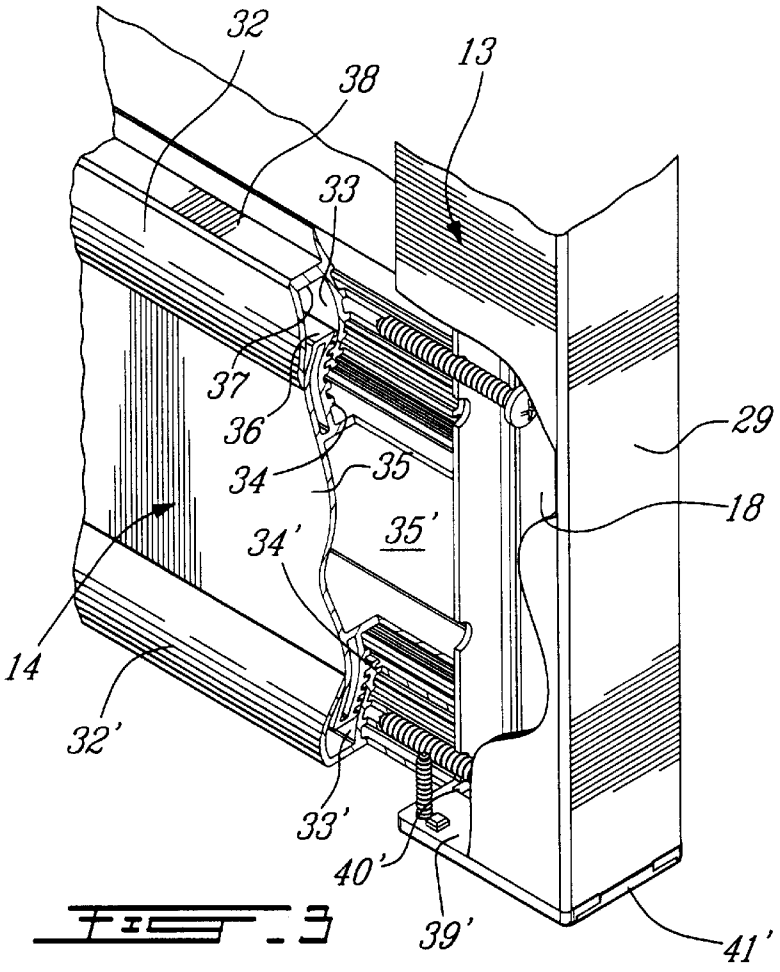
FIG. 3 is a perspective view of a corner of the shutter assembly of the present invention showing the adjustability of one of the bottom and top block members, herein the bottom block member.

With additional reference to FIG. 3 there is shown the construction of the bottom block member 14. The top block member 15 is formed in the same manner. As herein shown the end block members 14 and 15 are provided with top and bottom channel members 32 and 32' which are provided with a serrated inner wall 33 and 33' engageable with a serrated flange section 34 and 34' respectively of opposed facing side walls 35 and 35' whereby the height of the block members can be adjusted depending on the dimension of the support frame. The maximum adjustability is determined by the distance between the top wall 36 of the facing side wall 35 and the inner surface 37 of the end wall 38 of the channel members 32 and 32', respectively. This distance is provided at both ends of each the top and bottom block members and is sufficient to permit the construction of louvers having equidistantly spaced slats therealong as well as block members of substantially identical width.

Figure 4:
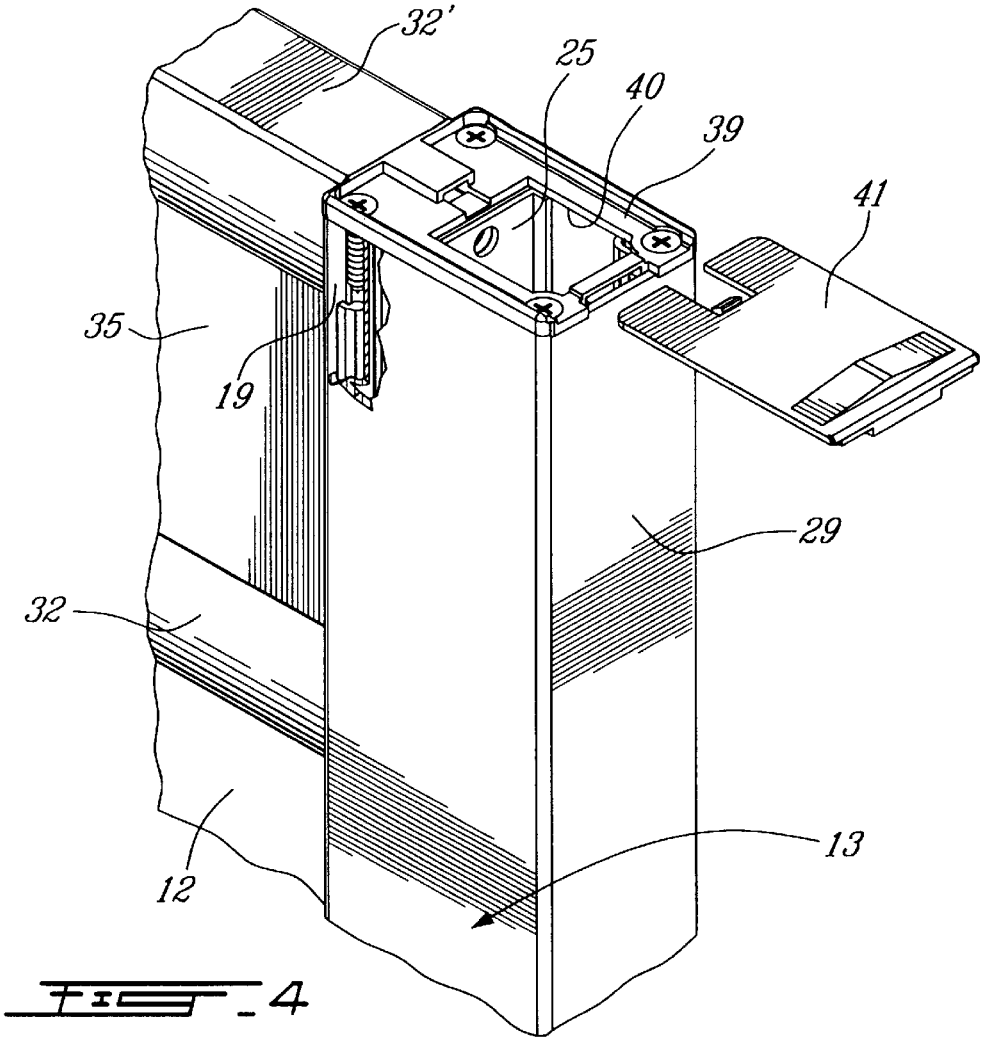
FIG. 4 is a fragmented perspective view showing the construction of the top end of one of the hollow side frame members.

As shown in FIGS. 3 and 4 the side frame members 13 and 13' are each provided with a top and bottom end wall 39 and 39' having an opening 40 and 40' formed therein for access to the interior of the side frame members. A cover plate 41 and 41' is snappingly secured to these end walls 39 and 39' and provide an esthetic finish to the corners of the shutter frame.

Figure 5A:
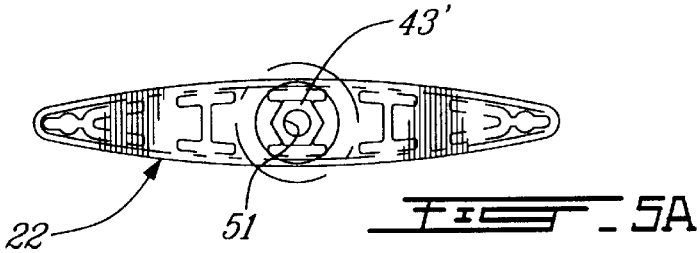
FIG. 5A is an end view of the end cap secured at opposed ends of the slats.
Figure 5B:
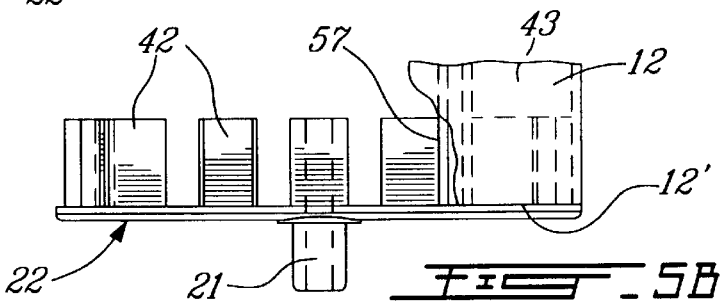
FIG. 5B is a top view of FIG. 5A.
Figure 6A:
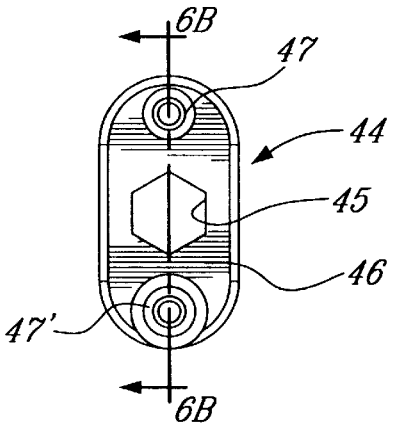
FIG. 6A is an end view of the pivot pin connector.
Figure 6B:
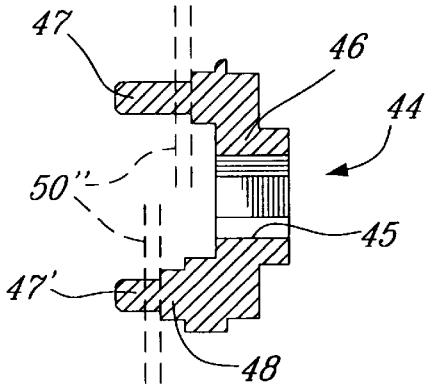
FIG. 6B is a cross-sectional side view of the pivot pin connector of FIG. 6A as seen along section lines 6B—6B.

FIGS. 5A and 5B illustrate the construction of the end caps 22 which are secured within the free ends 12' of the slats 12. The slats and end caps have an oblong shape and the end caps are provided with locating ribs 42 which fit within the ends of longitudinal channels 43 formed within the slats 12 whereby to strengthen the end of the slats as well as the connection of the end caps therewith. The end cap is formed with a pivot pin or pivot extension 21 which is provided with at least one flat wall portion 43' for locking interconnection with a pivot pin connector 44 as shown in FIG. 6A and 6B and as will be later described. As hereinshown the pivot pin 21 is of hexagonal cross-section whereby to be received in an hexagonal connecting cavity 45 of the pivot pin connector 44, as shown in FIGS. 6A and 6B.

The pivot pin connector 44 as shown in FIGS. 6A and 6B is provided with a base portion 46 having a pair of projecting connecting arms 47 and 47' which extend from the base and disposed diametrically aligned with the connecting bore 45. As hereinshown connecting arm 47' projects from a spacing base formation 48 which is disposed spaced above the base 46 whereby to maintain a pair of slat connecting bars 50 and 50' in spaced parallel relationship, as will be described later.

Figure 7:
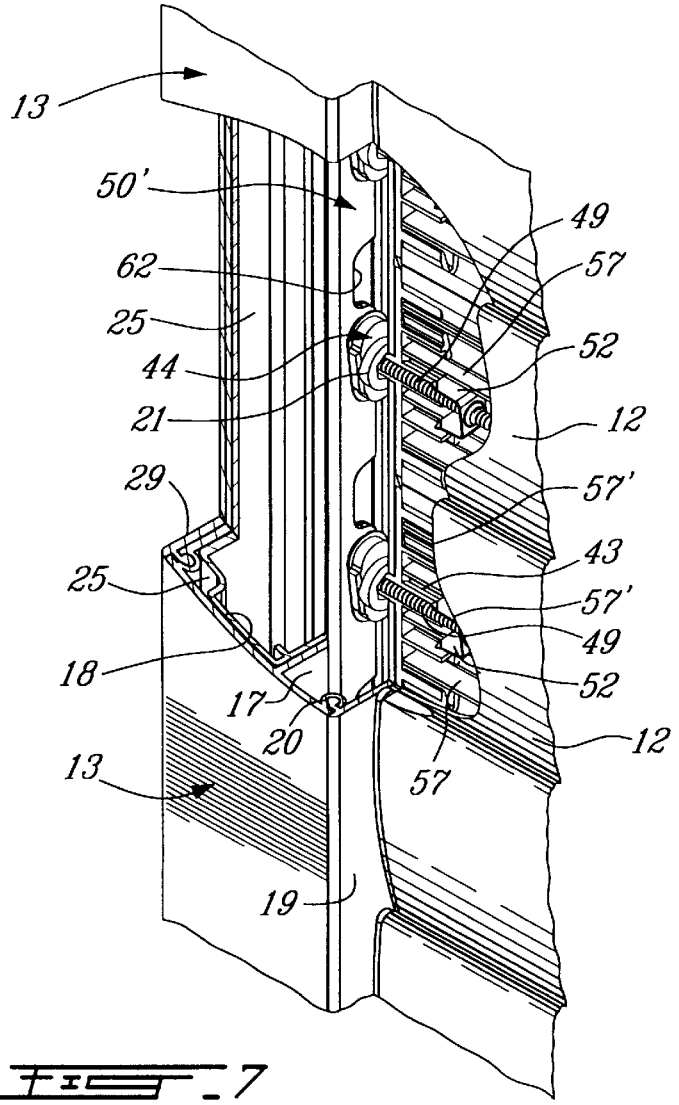
FIG. 7 is a fragmented perspective view showing the position of the slat positioning mechanism within the inner chamber of one of the hollow side frame members and the interconnection of the end cap with the slats and the position of the slat interconnecting bars.
Figure 8:
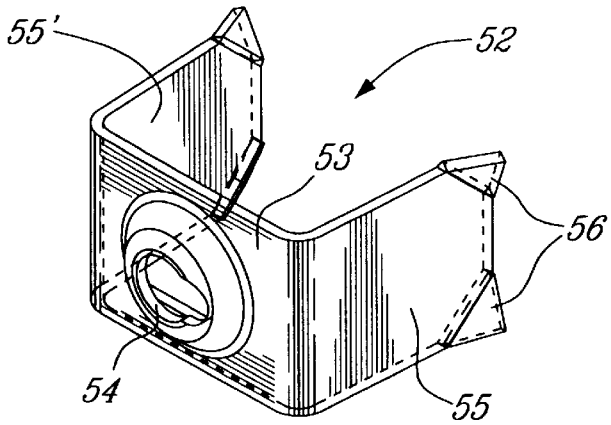
FIG. 8 is a perspective view of the spring nut which attaches the end cap of the slat thereto.

As shown in FIG. 7 the end caps 22 are secured in the free ends 12' of the slats 12 by a connecting fastener 49 which extends through the hole 51 provided in the pivot pin 21 and which engages at a free end thereof a spring clip 52. The construction of the spring clip is illustrated in FIG. 8 and as can be seen it consists of a connecting web 53 having a fastener engaging hole 54 at the center thereof and a pair of opposed transverse wing flanges 55 and 55'. The wing flanges have outwardly bent teeth portions 56 to engage the side walls 57' of a central connecting channel 43 of the slats 12 as shown in FIG. 5B. This interconnection is better illustrate in FIG. 7 and as can be seen when the fastener 49 is threaded it causes the cripping teeth 56 of the spring nut to be forced into the side walls 57 of the channel 43, as shown in FIG. 7.

Figure 9:
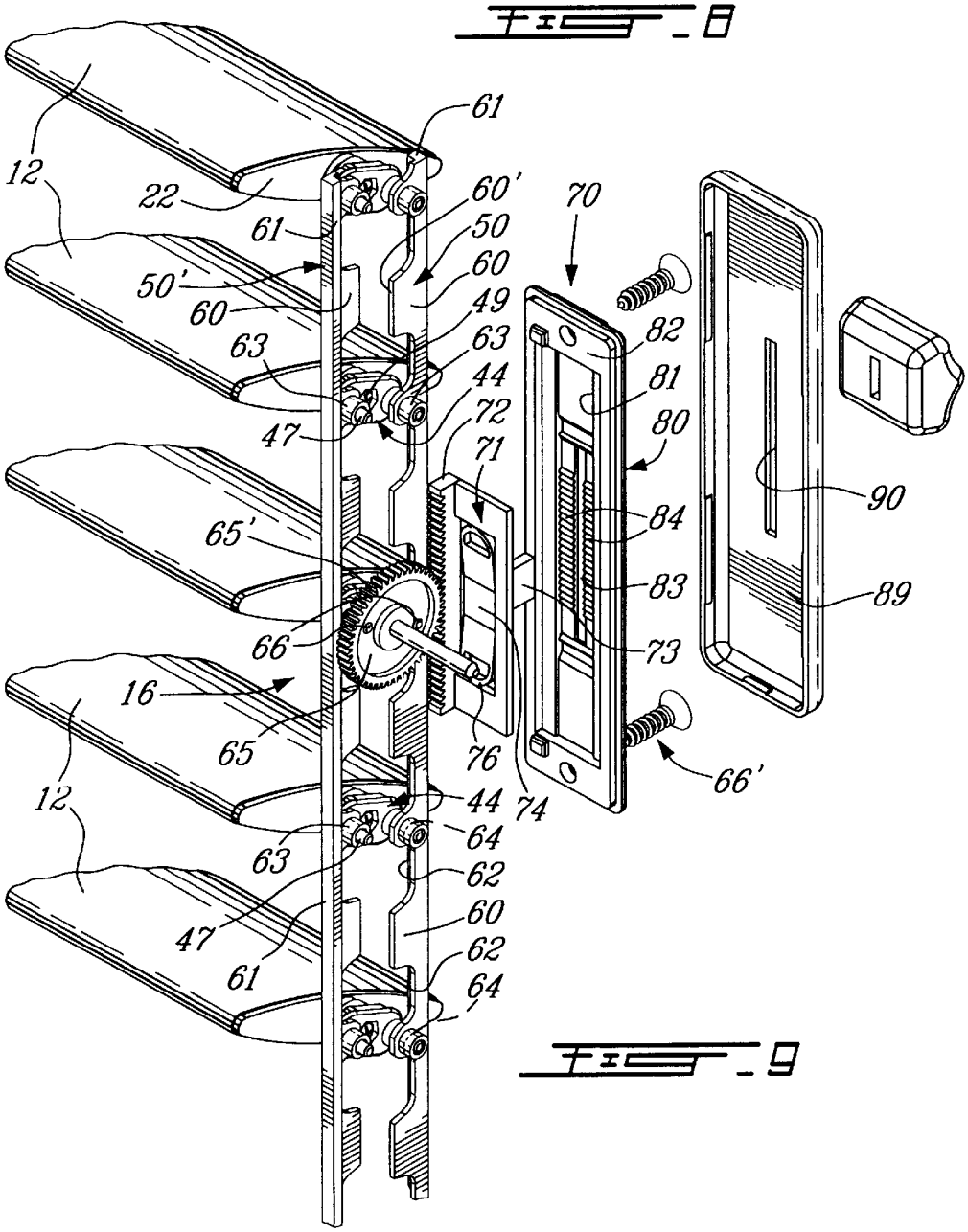
FIG. 9 is a perspective and exploded view showing the slat positioning mechanism and the controllable gear engaging means secured thereto.

Referring now to FIG. 9 there is shown the construction of the slat positioning mechanism 16 which is disposed in the inner chamber 17 of the side frame member 13. It is comprised of the pair of vertically disposed slat interconnecting bars 50 and 50' and pivot connectors 44 secured to each of the slats 12. As hereinshown the connecting bars 50 and 50' are metal bars herein aluminum bars each having a connecting flat wall section 60 and short transverse inturned end flange wall section 61. The connecting arms 47 and 47' are pivotally connected to these flat wall sections 60 and retained by friction sleeve connectors 63. The slide connecting bars are formed with spaced-apart holes 64 in their connecting flat wall section 60 to receive therethrough the connecting arms 47 and 47'. The connecting flat wall section 60 is also provided with a plurality of spaced-apart cavitated sections 62 for accomodating the connecting arms with it's friction sleeve connectors 63 when the bars move close to one another during their displacement.

As previously described with reference to FIG. 6B, one of the connecting arms, herein arm 47', is provided with an elevated base 48 so that the slat interconnecting bars 50 and 50' are spaced-apart in parallel planes, such planes 50" being illustrated in phantom lines in FIG. 6B. The friction sleeve connectors 63 maintain the connecting arms 47 and 47' in pivotal connection with the slat interconnecting bars. The pivot pin 21 is received within pivot holes 21' formed in the inner side walls of both side frame members 13 and 13' and this retains the slats in parallel relationship. The slat interconnecting bars 50 and 50' are freely suspended at their interconnection with the connecting arms 47 and 47' of the pivot pin connectors within the inner chamber 17 of the side frame member 13 and are displaced in translation by a control gear 65 and a controllable gear engaging means 66 as shown in FIG. 9.

As shown in FIG. 9 the control gear 65 is of circular disc shape and provided by a pair of connecting holes 66 disposed on a diametrical axis of the circular disc shape gear 65. These connecting holes 66 are spaced to receive an end extension portion of a respective one of the connecting arms 47 and 47' of one of the pivot pin connectors 44 secured to one of the plurality of slats extending through the slat interconnecting bars 50 and 50'. By rotating this control gear 65 it can be seen that the slat interconnecting bars 50 and 50' will move in translation to one another and tilt the slats in unison and in parallel relationship either in a clockwise or anti-clockwise direction. As the gear 65 is rotated from the position as shown in FIG. 9 one bar will move down and the other will move up and simultaneously the bars will come closer to one another. However, their movement will be limited by the end edge 60' of the connecting flat side walls 60 abutting against the end flange 61 of the opposite interconnecting bar 50' and vice versa if the rotation is in the other direction. As hereinshown the end flanges 61 are disposed in facing relationship with one another and their inner faces are aligned with the plane of the free edge 60' of the side wall 60.

It can be appreciated that as these side walls move closer to one another the cavitated section 62 will accommodate the passage of an associated one of the connecting arms and the friction sleeve connectors 63 of the pivot pin connector 44 to permit the displacement of these interconnecting bars to an overlap relationship.

Figure 11B:
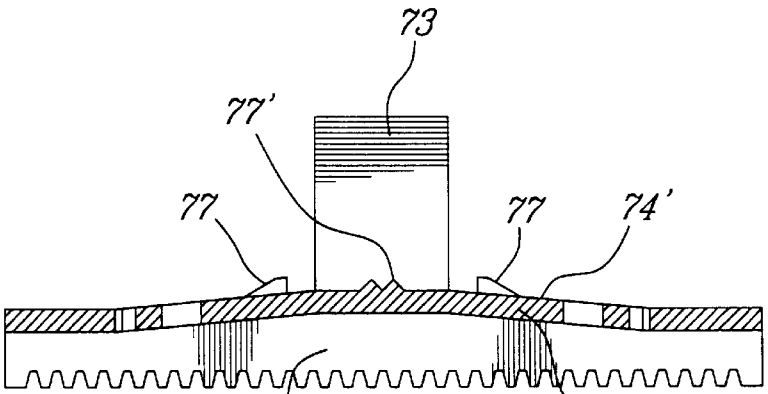
FIG. 11B is a side view of the spring-biased member having a control knob integrally formed therewith.
Figure 11A:
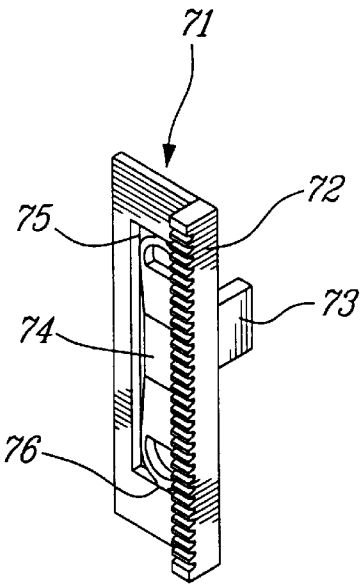
FIG. 11A is a perspective view showing the construction of the slider member provided with a toothed rack portion and a spring biased member.

Referring again to FIG. 9 there is shown one embodiment of the controllable gear engaging means and as hereinshown it is constituted by a slide positioner assembly 70 which is secured in the side frame member 13 only and disposed in the inner chamber 17 thereof. The slide positioner assembly as a slider member 71 which is better illustrated in FIGS. 11A and 11B and which is provided with a toothed rack portion 72 which, as shown in FIG. 9, is disposed in toothed engagement with the toothed periphery 65' of the control gear 65. Accordingly, as the toothed rack portion 72 moves up and down the control gear 65 will be rotated either counter clockwise or clockwise. A control knob 73 is integrally formed with the slider member 71 and extends from an outer wall 74' of a spring-biased member 74. The spring-biased member 74 is integrally formed within a slat 75 of the slide member and retained by a connecting web portion 76 at opposed ends thereof.

The spring-biased member 74 constitutes a position arresting means and is provided with one or more projecting teeth projecting above the outer wall 74' thereof.

Figure 10B:
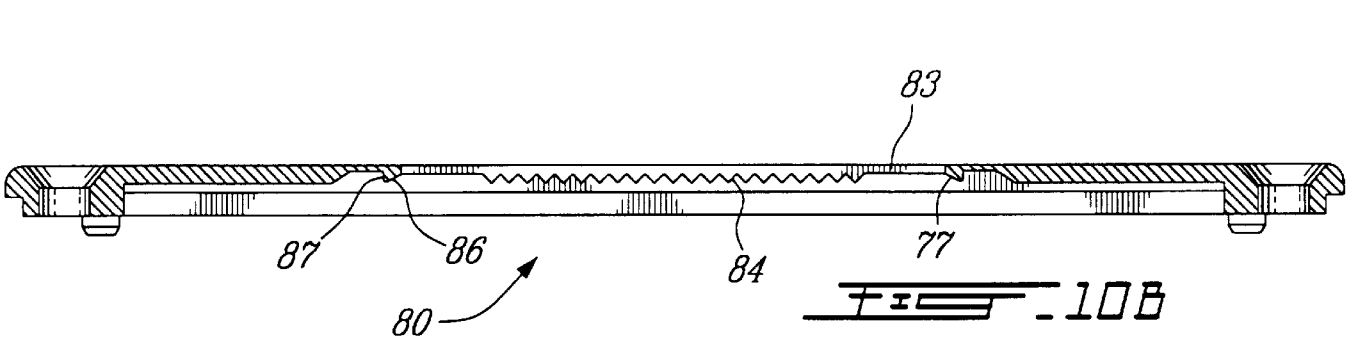
FIG. 10B is a section view taken along the longitudinal center axis of FIG. 10A.
Figure 10A:
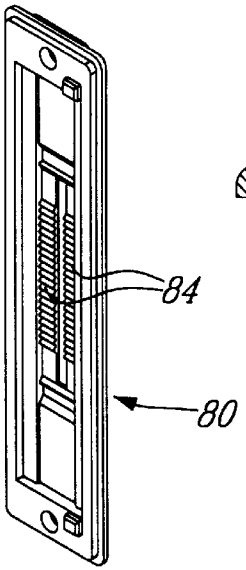
FIG. 10A is a perspective view showing the construction of the stationary wall having the serrated strip formation thereon and forming part of the controllable gear engaging means as shown in the exploded view in FIG. 9.

The slide position assembly 70 also comprises a stationary wall member 80, as better illustrated in FIGS. 10A and 10B and which is provided with a rectangular recess 81 in an inner surface 82 thereof whereby to receive the rectangular shape slider member 71 in close sliding fit therein. An elongated slot 83 permits the passage of the control knob 73 therethrough. A pair of serrated strip formations 84 are formed to each side of the slot and each contain a plurality of serrations for engagement by the projecting teeth 77 and 77' of the spring-biased member 74 which is biased thereagainst when the slide positioner assembly is assembled in a cavity formed in the side frame member 13. The spacing between the periphery of the control gear 65 and the side wall of the side frame member is predetermined whereby the rack 72 is in precise alignment and in toothed engagement with the toothed periphery of the control gear 65.

Figure 12A:
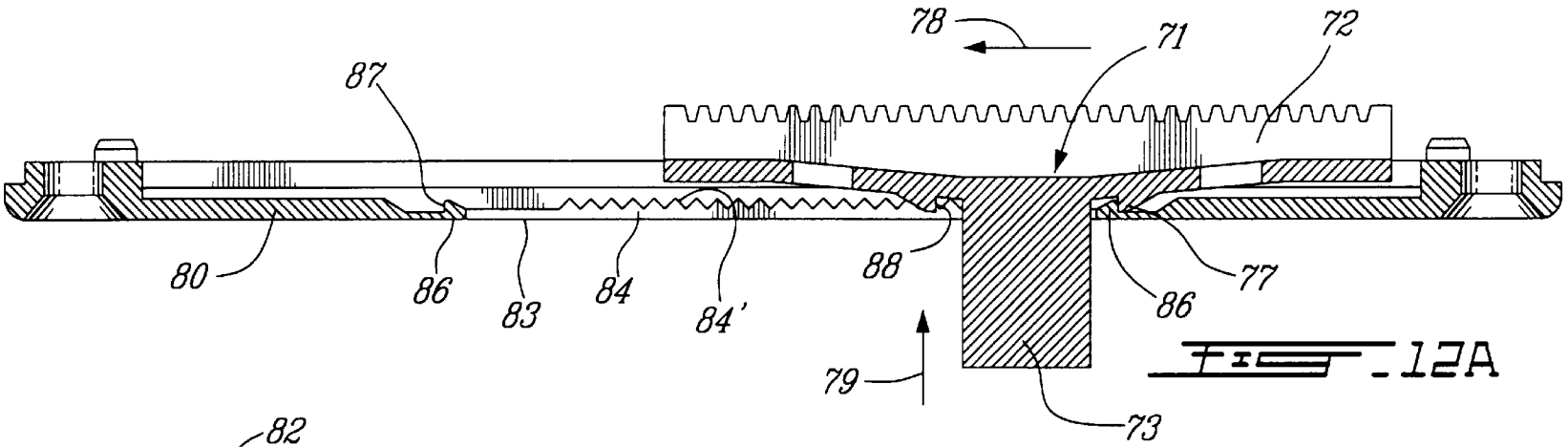
FIG. 12A is an assembly view of the slider member and the stationary wall having the serrated strip formations.
Figure 12B:
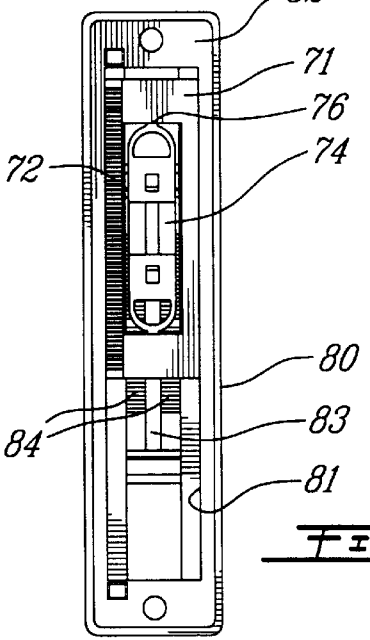
FIG. 12B is a top view of the assembly shown in FIG. 12A.

With reference to FIGS. 12A and 12B there is shown the interconnecting relationship between the projecting teeth of the spring-biased member 74 and the serrations of the serrated strip formations of the stationary wall. Accordingly, it can be seen that by pushing the control knob 73 in the direction of arrow 79 that the projecting teeth 77 and 77' will be released from engagement with the serrations 84' of the serrated strips 84 and the slider member 71 can be displaced in the direction of arrow 78. Because the rack 72 is in toothed engagement with the control gear 65 it will rotate the gear and thereby impart translation movement to the interconnecting bars 50 and 50' and thereby rotate the slats on their pivot pins to a desired angular position, all in unison and in parallel relationship. By releasing the pressure on the control knob the teeth will again be engaged with the serrations and the pressure connection by the spring-biased member 74 will maintain the slats at that desired position.

As can be seen in FIGS. 10A, 10B and 12A a tooth locking rib 86 is disposed at both ends of the serrated strip formations 84 for engagement by the projecting teeth 77 of the spring-biased member 71 for locking the slats 12 at a closed acute angular position tilted upwardly or downwardly. These tooth locking ribs 86 are provided with a vertical engaging wall 87 for non-sliding engagement with the vertical end wall 88 of the projecting teeth 77. The serrations 84' are shown as being pyramidal cross-section to permit ease of sliding of the slider member 71 thereover.

Figure 13:
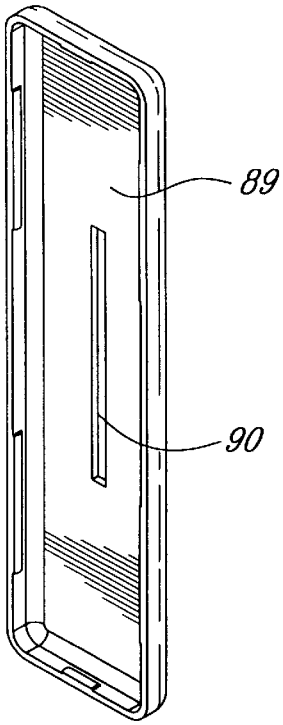
FIG. 13 is a rear perspective view of a cover plate which is retainable in snap-fit engagement over the assembly of FIG. 12A.

FIG. 13 is a perspective view of a face plate 89 which is snappingly secured about the periphery of the stationary wall member 80 illustrated in FIGS. 9 and 10A and conceals the slot opening which is formed into the side wall of the hollow side frame member 13. This cover 89 is also provided with a slot 90 for the passage of the control knob 73. Accordingly, the control gear engaging mechanism 66' is concealed within the hollow side frame member 13 with only the face plate 89 and the control knob 73 being visible but blending within the side frame 13.

Figure 14:
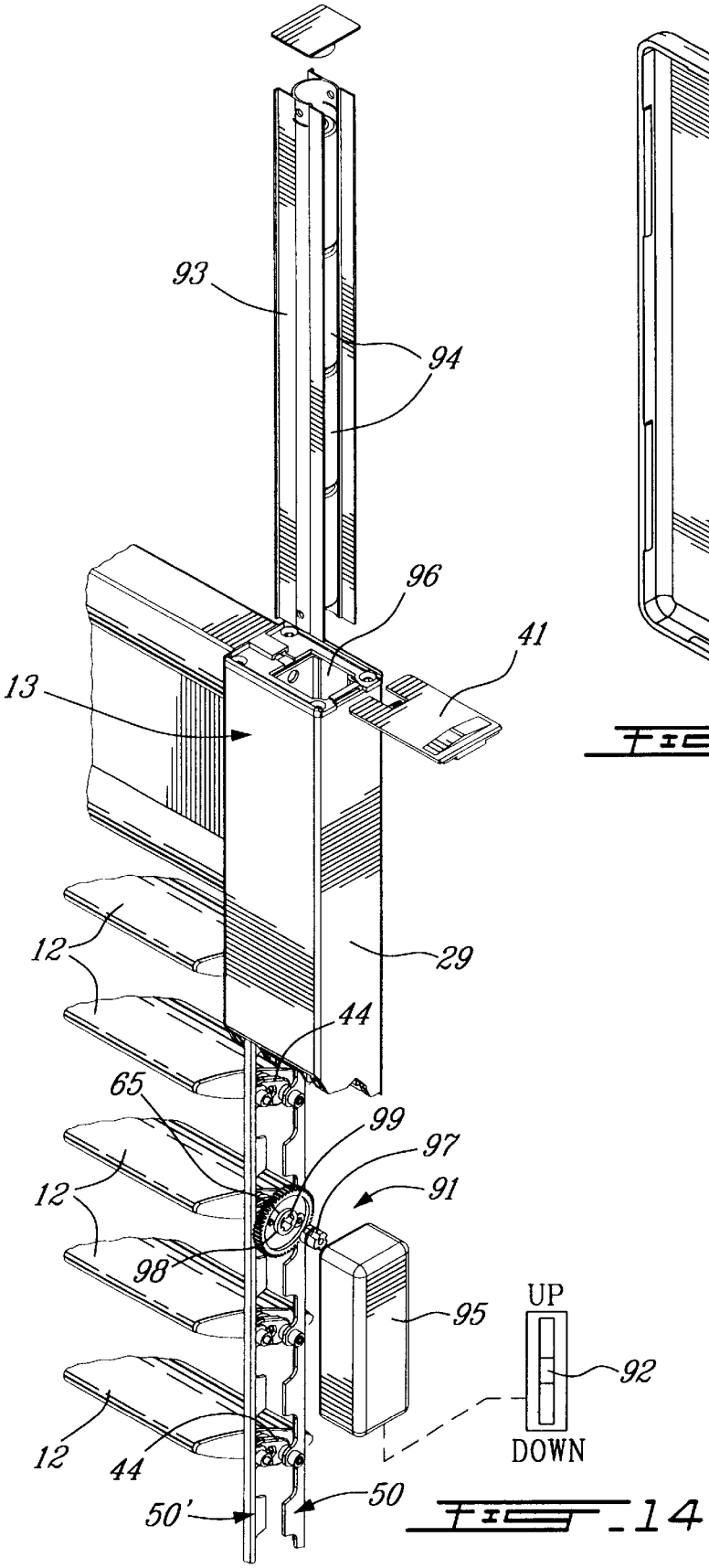
FIG. 14 is an exploded fragmented section view of a corner of the shutter assembly of the present invention illustrating another embodiment of the controllable gear engaging means, herein an automatic motor-driven slat positioning mechanism.

Referring now to FIG. 14 there is shown a further embodiment of the controllable gear engaging means and it is herein constituted by a drive motor 95 located in a housing 95'. A drive shaft (not shown) drivingly engages a gear coupling 91 which is engaged with the control gear 65. A finger-operated switch control 92 is coupled to the motor to impart clockwise or counter clockwise rotation thereto and a suitable gear train is mounted in the housing 95' whereby to slowly turn the control gear in a clockwise or counter clockwise direction to impart a desirable pivoting motion to the slats 12. An elongated battery magazine 93 provides power for the drive motor 95. This magazine is adapted to be removably positioned within a locating bore 96 formed in a top end section of the side frame member 13.

As shown in FIG. 14 the gear coupling 91 is a cylindrical coupling having peripheral lug formations 97 which are spaced-apart and adapted for close fit engagement in a hub cavity 98 of the control gear 65. The lug formations 97 are received in engaging peripheral slots 99 of the hub cavity. The cover plate 41 closes the open top wall of the hollow side frame member 13 after the magazine 93 is positioned therein.

It is pointed out that the shutter assembly 10 of the present invention is formed of extruded and molded plastic parts and is free of adhesively secured parts. The interconnection of these parts permit the shutter assembly to be custom-built with a support frame having equidistantly spaced slats between the bottom and top block members which are also formed of adjustable parts to vary the width thereof.

It is in the ambit of the present invention to cover any obvious modifications of the preferred embodiments described herein, provided such modifications fall within the scope of the appended claims.

What is claimed is:

1. A shutter assembly comprising a support frame formed by opposed parallel hollow side frame members and bottom and top block members each connected to said side frame members adjacent an associated pair of opposed ends of said side frame members; a plurality of equidistantly spaced slats are pivotally secured between said side frame members in pivotal parallel relationship and pivotally interconnected to one another in one of said hollow side frame members, said side frame members each having a removably securable inner side wall provided with equidistantly spaced holes each receiving an associated one of a pair of opposed pivot pins of each said slat, a slat positioning mechanism is disposed in said one of said side frame members, said positioning mechanism having a pair of vertically disposed slat interconnecting bars, pivot pin connectors secured to said pivot pins, each of said pivot pin connectors having a connecting bore secured to one of said pivot pins of said slats, each of said pivot pin connectors further having a pair of connecting arms each pivotally connected to a respective one of said pair of slat interconnecting bars, one of said connecting arms of each said pivot pin connector projects from a spacing base formation disposed above a base of said pivot pin connector which maintains said slat interconnecting bars in spaced parallel planes, a control gear having a circular disc shape is provided with gear teeth on at least an outer peripheral portion thereof, said gear having a pair of pivotal connections secured to a respective one of said pair of slat interconnecting bars, said pair of pivotal connections having a pivot axis extending parallel to an axis at a center of said gear, controllable gear engaging means for rotating said control gear to a desired position to displace said interconnecting bars to tilt said slats in unison to a desired angle and to hold said slats at said desired angle.

2. A shutter assembly as claimed in claim 1 wherein said slat interconnecting bars are each provided with equidistantly spaced connecting holes, said connecting arms each having a circular cross-section and rotatably received in a designated one of said connecting holes, and arm connectors for retaining said connecting arms in said connecting holes.

3. A shutter assembly as claimed in claim 2 wherein said slat interconnecting bars are freely suspended in said one of said side frame members by said slat pivot pins through said pivot pin connectors.

4. A shutter assembly as claimed in claim 3 wherein said hollow side frame members are each formed of plastic extruded parts and define two chambers, each said removably securable inner side wall providing access to a first of said two chambers of a respective one of said side frame members, and a second of said two chambers of each said side frame member having a reinforcing hollow metal tube closely fitted therein to strengthen said side frame member, each said second chamber having an inner side wall and an outer side wall and opposed parallel front and rear walls, pivot holes in said inner side walls of said second chambers and said metal tubes receive free ends of said pivot pins therethrough.

5. A shutter assembly as claimed in claim 4 wherein there is further provided side wall facing strips remobably secured over said outer side walls of said second chambers to conceal access holes formed in said outer side walls for access to said free ends of said pivot pins extending through said pivot holes.

6. A shutter assembly as claimed in claim 1 wherein said controllable gear engaging means is constituted by a drive motor, said drive motor having a gear train coupling engaged with said control gear, a finger operated switch control to operate said motor, and a battery magazine to provide power for said drive motor, said magazine being adapted to retain at least one battery and removably retained in a top end section of said one of said side frame members.

7. A shutter assembly as claimed in claim 6 wherein said gear train coupling is a cylindrical coupling having peripheral lug formations adapted to fit in a hub cavity of said control gear, said lug formations being received in engaging peripheral slots of said hub cavity.

8. A shutter assembly as claimed in claim 1 wherein a spacing of said holes is determined by a dimension of said slats and said side frame members of said support frame, each of said bottom and top block members being formed by two parts each with an adjustably connectable facing side wall to vary a height of said block member depending on a desired dimension of said support frame.

9. A shutter assembly as claimed in claim 1 wherein each of said pivot pins has at least one flat elongated surface for matting connection with a corresponding flat wall portion of said connecting bore of a respective one of said pivot pin connectors.

10. A shutter assembly as claimed in claim 1 wherein said control gear pivotal connections are provided by a pair of spaced-apart connecting holes each disposed on a diametrical axis of said circular disc shape control gear, said connecting holes each being adapted to receive an end extension portion of a respective one of said connecting arms of said respective one of said pivot pin connectors.

11. A shutter assembly as claimed in claim 1 wherein said slat interconnecting bars each comprise metal plates having a connecting flat wall section and a short transverse inturned end flange wall.

12. A shutter assembly as claimed in claim 11 wherein each connecting flat wall section has a plurality of spaced-apart cavitated sections for passage of one of said connecting arms to permit said slat interconnecting bars to be displaced from a side-by-side spaced relationship to an overlapping relationship as said slats are angulated from a horizontal open position to a closed position.

13. A shutter assembly as claimed in claim 12 wherein said inturned end flange walls are disposed in facing one another and each said inturned end flange wall provides an abutment for an end edge of said connecting flat wall section of the other of said pair of slat interconnecting bars.

14. A shutter assembly as claimed in claim 1 wherein each said pivot pin includes an integrally formed end cap, a through bore which receives a connecting fastener therethrough and a spring nut secured to said fastener, wherein each said pivot pin is detachably secured to one of two opposed ends of a respective one of said slats by said spring nut of said pivot pin extending into an engaging channel of said respective one of said slats and said fastener of said pivot pin causing said spring nut of said pivot pin to be immovably engaged with said engaging channel, said pivot pins having a hexagonal outer cross-section for non-rotational engagement with said pivot pin connectors.

15. A shutter assembly as claimed in claim 1 wherein said controllable gear engaging means is constituted by a slide positioner assembly secured in said one of said side frame members, said slide positioner assembly provided with a toothed rack portion in toothed engagement with said control gear, a control knob, a slider member and a position arresting means for positively arresting said slider member and holding said slats at said desired angle.

16. A shutter assembly as claimed in claim 15 wherein said position arresting means is provided by a spring-biased member secured to said slider member, said control knob being secured to said spring-biased member, said spring-biased member having at least one projecting tooth, said spring-biased member being biased against a stationary wall member having a plurality of serrations for engagement by said at least one projecting tooth, said stationary wall having a slotted aperture for receiving said control knob therethrough, said at least one projecting tooth being disengaged from said serrations by pushing said control knob away from said stationary wall member.

17. A shutter assembly as claimed in claim 16 wherein said stationary wall member is further provided with tooth locking ribs each disposed at an opposite end of said plurality of serrations for engagement by said at least one projecting tooth of said spring-biased member for locking said slats at a closed position.

18. A shutter assembly as claimed in claim 16 wherein said stationary wall member is secured over a slot formed in said one of said side frame members adjacent said control gear.

19. A shutter assembly as claimed in claim 1 wherein said shutter assembly is formed of extruded and molded plastic parts and free of adhesive to secure said parts, said bottom and top block members each being formed of adjustable parts to vary a height thereof.

20. A shutter assembly comprising a support frame formed by opposed parallel hollow side frame members and bottom and top block members each connected to said side frame members adjacent an associated pair of opposed ends of said side frame members; a plurality of equidistantly spaced slats are pivotally secured between said side frame members in pivotal parallel relationship and pivotally interconnected to one another in one of said hollow side frame members, said side frame members each having a removably securable inner side wall provided with equidistantly spaced holes each receiving an associated one of a pair of opposed pivot members of each said slat, a slat positioning mechanism is disposed in said one of said side frame members, said positioning mechanism having a pair of vertically disposed slat interconnecting bars, pivot member connectors secured to said pivot members, each of said pivot member connectors further having a pair of connecting arms each pivotally connected to a respective one of a pair of slat interconnecting bars, a control gear having a circular disc shape is provided with gear teeth on at least an outer peripheral portion thereof, said gear having a pair of pivotal connections each secured to a respective one of said pair of slat interconnecting bars, each of said pair of pivotal connections having a pivot axis extending parallel to an axis at a center of said gear, controllable gear engaging means for rotating said control gear to a desired position to displace said interconnecting bars to tilt said slats in unison to a desired angle and to hold said slats at said desired angle, each said pivot member includes an integrally formed end cap, a through bore which receives a connecting fastener therethrough and a spring nut secured to said fastener, wherein each said pivot member is detachably secured to one of two opposed ends of a respective one of said slats by said spring nut of said pivot member extending into an engaging channel of said respective one of said slats and said fastener of said pivot member causing said spring nut of said pivot member to be immovably engaged with said engaging channel, said pivot member having a hexagonal outer cross-section for non-rotational engagement with said pivot member connectors.

* * * * *